US009903367B2

(12) United States Patent
Watanabe et al.

(10) Patent No.: US 9,903,367 B2
(45) Date of Patent: Feb. 27, 2018

(54) VARIABLE DISPLACEMENT OIL PUMP

(71) Applicant: HITACHI AUTOMOTIVE SYSTEMS, LTD., Hitachinaka-shi, Ibaraki (JP)

(72) Inventors: Yasushi Watanabe, Kanagawa (JP); Hideaki Ohnishi, Atsugi (JP); Koji Saga, Ebina (JP); Atsushi Naganuma, Atsugi (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 140 days.

(21) Appl. No.: 14/923,715

(22) Filed: Oct. 27, 2015

(65) Prior Publication Data

US 2016/0177950 A1 Jun. 23, 2016

(30) Foreign Application Priority Data

Dec. 18, 2014 (JP) ..... 2014-255685

(51) Int. Cl.
*F01C 20/18* (2006.01)
*F03C 2/02* (2006.01)
(Continued)

(52) U.S. Cl.
CPC ..... *F04C 14/226* (2013.01); *F01M 1/02* (2013.01); *F01M 1/16* (2013.01); *F04C 2/344* (2013.01);
(Continued)

(58) Field of Classification Search
CPC ..... F04C 14/226; F01M 1/16
(Continued)

(56) References Cited

U.S. PATENT DOCUMENTS 5,518,380 A 5/1996 Fujii et al.
6,530,752 B2 * 3/2003 Oba ..... F04C 14/226 417/220
(Continued)

FOREIGN PATENT DOCUMENTS

EP 2 253 847 A1 11/2010
JP 59-070891 A 4/1984
(Continued)

OTHER PUBLICATIONS

U.S. Appl. No. 14/884,310, filed Oct. 15, 2015, Hitachi Automotive Systems, Ltd.
(Continued)

*Primary Examiner* — Mark Laurenzi
*Assistant Examiner* — Deming Wan
(74) *Attorney, Agent, or Firm* — Foley & Lardner LLP

(57) ABSTRACT

A variable displacement oil pump for an internal combustion engine includes a pump element to vary inside volumes of pumping chambers to suck and discharge an oil, a varying mechanism to vary a pumping volume variation quantity of the pumping chambers, with movement of a movable member such as a cam ring, an urging mechanism to urge the movable member in a direction to increase the pumping volume variation quantity, first and second control oil chambers to urge the movable member to vary the pumping volume variation quantity, and a control mechanism, such as a pilot valve, to control the supply/drainage of the oil to or from the second control oil chamber. An operation oil pressure of the movable member is set higher than an operation oil pressure of the control mechanism in a higher pressure region.

8 Claims, 12 Drawing Sheets

(51) Int. Cl.

| | |
|---|---|
| ***F03C 4/00*** | (2006.01) |
| ***F04C 14/18*** | (2006.01) |
| ***F04C 28/18*** | (2006.01) |
| ***F04C 14/22*** | (2006.01) |
| ***F04C 2/344*** | (2006.01) |
| ***F04C 15/00*** | (2006.01) |
| ***F04C 15/06*** | (2006.01) |
| ***F01M 1/02*** | (2006.01) |
| ***F01M 1/16*** | (2006.01) |

(52) U.S. Cl.
CPC ..... *F04C 15/008* (2013.01); *F04C 15/06* (2013.01); *F01M 2001/0238* (2013.01); *F01M 2001/0246* (2013.01)

(58) Field of Classification Search
USPC ..... 418/30, 27, 24–26, 31
See application file for complete search history.

(56) References Cited

U.S. PATENT DOCUMENTS

| | | | | |
|---|---|---|---|---|
| 6,672,844 | B2 | 1/2004 | Fukanuma et al. | |
| 7,794,217 | B2 | 9/2010 | Williamson et al. | |
| 8,317,486 | B2 | 11/2012 | Williamson et al. | |
| 8,684,702 | B2 | 4/2014 | Watanabe et al. | |
| 9,109,596 | B2 | 8/2015 | Ohnishi et al. | |
| 9,410,514 | B2 | 8/2016 | Watanabe | |
| 9,494,152 | B2 | 11/2016 | Saga | |
| 9,494,153 | B2 | 11/2016 | Watanabe et al. | |
| 9,670,925 | B2 | 6/2017 | Watanabe et al. | |
| 2008/0308062 | A1 | 12/2008 | Morita et al. | |
| 2009/0022612 | A1 | 1/2009 | Williamson et al. | |
| 2010/0028171 | A1 | 2/2010 | Shulver et al. | |
| 2010/0205952 | A1 | 8/2010 | Yamamuro et al. | |
| 2010/0329912 | A1 | 12/2010 | Williamson et al. | |
| 2011/0085921 | A1 | 4/2011 | Kato et al. | |
| 2011/0123379 | A1 | 5/2011 | Saga et al. | |
| 2011/0194967 | A1* | 8/2011 | Watanabe | F04C 14/226 418/138 |
| 2012/0213655 | A1 | 8/2012 | Ohnishi et al. | |
| 2013/0089446 | A1 | 4/2013 | Williamson et al. | |
| 2013/0164162 | A1 | 6/2013 | Saga | |
| 2013/0164163 | A1 | 6/2013 | Ohnishi et al. | |
| 2013/0195705 | A1 | 8/2013 | Williamson et al. | |
| 2014/0072456 | A1 | 3/2014 | Watanabe et al. | |
| 2014/0072458 | A1 | 3/2014 | Watanabe | |
| 2014/0119969 | A1 | 5/2014 | Iijima | |
| 2014/0147322 | A1 | 5/2014 | Saga | |
| 2014/0219847 | A1 | 8/2014 | Watanabe et al. | |
| 2015/0020759 | A1 | 1/2015 | Watanabe et al. | |
| 2015/0218983 | A1 | 8/2015 | Watanabe et al. | |
| 2017/0030351 | A1 | 2/2017 | Saga | |

FOREIGN PATENT DOCUMENTS

| | | | |
|---|---|---|---|
| JP | 2004-218529 | A | 8/2004 |
| JP | 2008-524500 | A | 7/2008 |
| JP | 2011-080430 | A | 4/2011 |
| JP | 2011-111926 | A | 6/2011 |
| JP | 2013-130090 | A | 7/2013 |
| JP | 2014-105623 | A | 6/2014 |
| WO | WO-2012/113437 | A1 | 8/2012 |

OTHER PUBLICATIONS

U.S. Appl. No. 15/584,283, filed May 2, 2017, Watanabe et al.
Saga: Non-Final US Office Action on U.S. Appl. No. 14/073,347 dated Aug. 14, 2015.
Saga: Non-Final US Office Action on U.S. Appl. No. 15/290,394 dated Aug. 10, 2017.
Saga: US Notice of Allowance on U.S. Appl. No. 14/073,347 dated Jul. 21, 2016.
Saga: Final US Office Action on U.S. Appl. No. 14/073,347 dated Apr. 8, 2016.
Watanabe et al.: US Notice of Allowance on U.S. Appl. No. 13/852,636 dated Mar. 24, 2016.
Watanabe et al.: US Notice of Allowance on U.S. Appl. No. 13/974,686 dated Feb. 1, 2017.
Watanabe et al.: US Notice of Allowance on U.S. Appl. No. 14/073,357 dated Jun. 29, 2016.
Watanabe et al.: Non-Final US Office Action on U.S. Appl. No. 13/852,636 dated Aug. 28, 2015.
Watanabe et al.: Non-Final US Office Action on U.S. Appl. No. 14/073,357 dated Aug. 31, 2015.
Watanabe et al.: Non-Final US Office Action on U.S. Appl. No. 13/974,686 dated Mar. 24, 2016.

* cited by examiner

VARIABLE DISPLACEMENT OIL PUMP

BACKGROUND OF THE INVENTION

The present invention relates to a variable displacement oil pump used as an oil pressure source for supplying oil to sliding contact portions of an internal combustion engine, for example.

An example of the variable displacement pump is shown in JP 2014-105623A (corresponding to US2014/0219847A1).

To supply the oil discharged from the oil pump to various sections having different required oil pressure levels, such as sliding contact portions of an internal combustion engine and a variable valve actuating device for controlling an operating characteristic of an engine valve, there is a recent demand for a two-step or multistep characteristic having a lower pressure characteristic for a first rotational seed region, and a higher pressure characteristic for a second rotational speed region.

The variable displacement oil pump of the above-mentioned patent document is designed to satisfy such a demand, with first and second control oil chambers formed between a pump housing and a cam ring. By controlling the introduction of the discharge pressure into the first and second control oil chambers with a pilot valve in accordance with an urging force based on the internal pressure in the first control oil chamber, to urge the cam ring in a direction decreasing the eccentricity or eccentricity quantity of the cam ring (concentric direction), an urging force based on the internal pressure in the second control oil chamber, to urge the cam ring in a direction increasing the eccentricity of the cam ring (eccentric direction), and a spring force of a spring to urge the cam ring in the eccentric direction, this variable displacement oil pump controls the eccentricity of the cam ring in a manner of two steps in dependence on the engine speed, and thereby satisfies the different required discharge pressure levels.

SUMMARY OF THE INVENTION

In this variable displacement oil pump, no consideration is given to an urgent force based on the internal pressure of each pumping chamber (PR) although the operation oil pressure of the cam ring should be determined by the urgent forces based on the internal pressures of the first and second control oil chambers, the urgent force based on the resilient force of the spring, and the urgent force based on the internal pressures of the pumping chambers.

Therefore, specifically in a high speed region corresponding to the second speed region, there is a tendency of generation of air voids (aeration) during the suction, and the internal pressures of the pumping chambers in the discharge region for compressing and discharging the oil, might be deceased and cause the cam ring to move (swing) before attainment of a predetermined set pressure level.

The present invention has been devised in view of the above-mentioned technical problem in the variable displacement oil pump. It is an object of the present invention to provide a variable displacement fluid pump to maintain an adequate operation pressure of a cam ring despite occurrence of aeration, and to achieve a higher fluid pressure desirable for an internal combustion engine.

According to the present invention, there are provided a first control oil or fluid chamber to receive an operating fluid or oil discharged from a discharge portion and thereby to produce an urging force (T1) to urge a movable member (15) in a direction to decrease a pumping volume variation quantity of the pumping chambers, a second control oil or fluid chamber (32) to receive the fluid discharged from the discharge portion and thereby to produce an urging force to urge the movable member in a direction to vary the pumping volume variation quantity, and a control mechanism or section operated before the pumping volume variation quantity becomes smallest, and arranged to discharge the fluid from the second control oil chamber or to supply the fluid to the second control oil chamber with increase in a discharge pressure of the fluid discharged from the discharge portion. In a higher pressure region higher than a predetermined or highest fluid pressure required by the internal combustion engine, an operation fluid pressure of the movable member is set higher than an operation fluid pressure of the control mechanism.

DETAILED DESCRIPTION OF THE INVENTION

Embodiment(s) of the present invention is explained hereinafter with reference to the drawings. In the illustrated embodiment, the variable displacement oil pump is adapted to supply a lubricating oil to various parts of an internal combustion engine for a motor vehicle, such as sliding contact portions, and a valve timing control apparatus used for control of opening/closing timings of engine valves.

Figure 1:
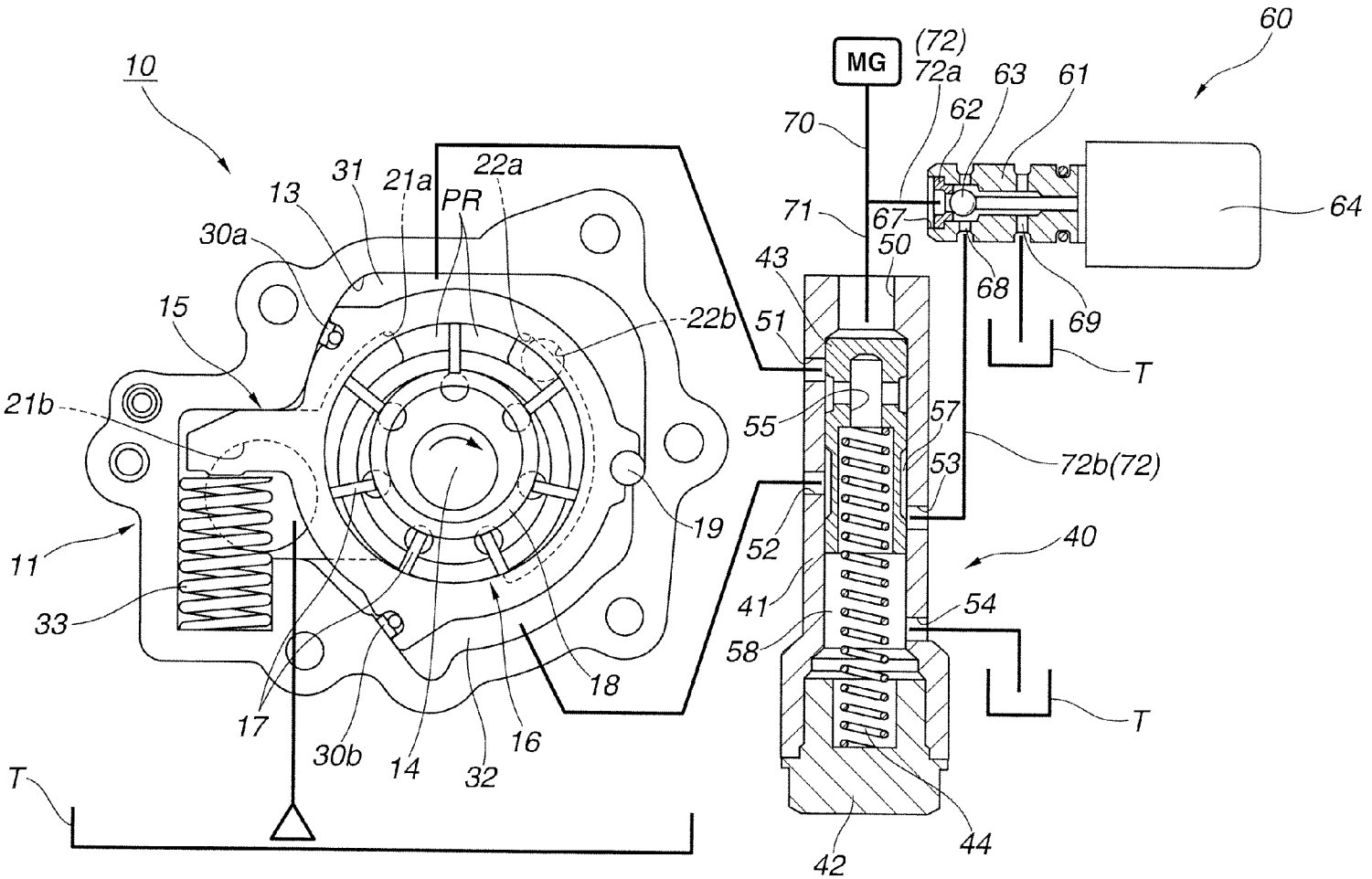
FIG. 1 is a hydraulic circuit diagram of a variable displacement pump according to an embodiment of the present invention.

An oil pump 10 shown in FIG. 1 is provided at front end portion of a cylinder block (not shown) of an internal combustion engine, for example. As shown in FIG. 1, oil pump 10 includes a pump housing, a drive shaft 14, a cam ring 15, a pump element, a pilot valve 40, and a solenoid valve 60.

The pump housing includes a pump body 11 shaped like a cup having a cylindrical wall and a bottom or end wall dosing one end of the cylindrical wall, to define a pump receiving chamber 13 in the pump body 11, and a pump cover (not shown) closing the open end of pump body 11. The drive shaft 14 is supported rotatably by the pump housing, and arranged to extend through a center portion of the pump receiving chamber 13 and to be driven by a crankshaft (not shown) of the engine.

The cam ring 15 serves as a movable (or swingable) member received movably (or swingably) in the pump receiving chamber 13, and constitutes a varying mechanism varying a volume variation or volume variation quantity of each of later-mentioned pumping chambers PR in cooperation with later-mentioned first and second control oil chambers 31 and 32, and a coil spring 33.

The pump element is received in, and surrounded by, the cam ring 15. The pump element is arranged to be driven and rotated by drive shaft 14 in the clockwise direction in FIG. 1 and thereby to perform a pumping action to increase/decrease the volumes of pumping chambers PR formed between the cam ring 15 and the pump element. The pilot valve 40 serves as a control mechanism provided on a downstream side of an oil main gallery MG of the internal combustion engine, and arranged to control the supply and drainage (or discharge) of the oil pressure (control pressure) to the first and second control oil chambers 31 and 32. The solenoid valve 60 is provided in an oil passage (later-mentioned second introduction passage 72) branching off from the oil main gallery MG, and arranged to perform a selection or changeover control of the introduction of the control oil supplied to the pilot valve 40.

The pump element or pump member (or rotary member) of this example includes a rotor 16, a plurality of vanes 17 and a pair of ring members 18. The rotor 16 is received rotatably in cam ring 15, and mounted on drive shaft 14 so that the center portion of rotor 16 is fit over the outside surface of drive shaft 14. Rotor 16 includes an outer circumferential portion formed with a plurality of slits 16*a* formed radially, and arranged to receive the vanes 17, respectively. Each vane 17 can move radially in a corresponding one of the slits 16*a* (in the radial outward direction to project outward and in the radial inward direction to withdraw deeper). The ring members 18 are smaller in diameter than rotor 16. The two ring members 18 are disposed on both sides of rotor 16 so that a radial inner portion of rotor 16 is sandwiched between the two ring members 18.

Figure 2:
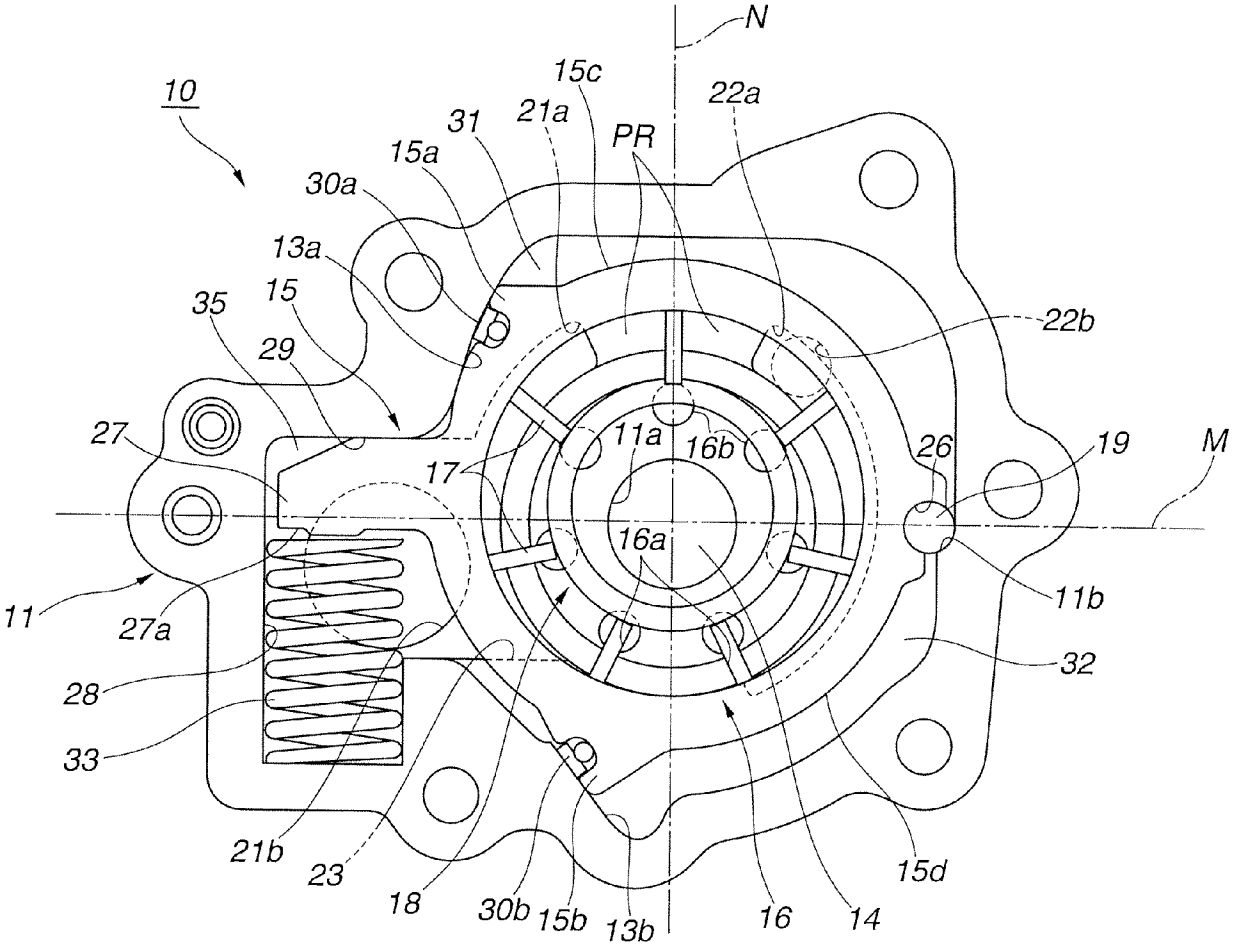
FIG. 2 is an enlarged view of the variable displacement pump shown in FIG. 1.

The pump body 11 is a single integral member of aluminum alloy material. As shown in FIG. 2, a shaft hole 11*a* is opened substantially at a center position through the end wall or bottom of pump receiving chamber 13, and arranged to support one end of the drive shaft 14 rotatably. In an area surrounding the central shaft hole 11*a*, there are formed suction port 21*a* and discharge port 22*a* confronting each other diametrically across the central shaft hole 11*a*. The suction port 21*a* serving as a suction portion is opened in a region (suction region) where the inside volume of each pumping chamber PR is increased in accordance with the pumping action of the pump element, and shaped to have an arc recess extending circumferentially like a circular arc. The discharge port 22*a* serving as a discharge portion is opened in a region (discharge region) where the inside volume of each pumping chamber PR is decreased, and shaped to have an arc recess extending circumferentially like a circular arc.

A support recess 11*b* is formed at a predetermined position in the inside circumferential wall of pump receiving chamber 13. The support recess 11*b* is shaped to have a substantially semicircular cross sectional shape and to support a rod-shaped pivot pin 19 for supporting the cam ring 15 swingably. This inside circumferential wall of pump receiving chamber 13 is formed with a first seal slide surface 13*a* and a second seal slide surface 13*b*. The first seal slide surface 13*a* is formed on an upper side of an imaginary straight line M (hereinafter referred to as a cam ring reference line) connecting the center of support recess 11*b* (or the axis of the pivot pin 19) and the center of central shaft hole 11*a* (or the axis of drive shaft 3), as viewed in FIG. 2. The first seal surface 13*a* is shaped to be always held in sliding contact with a later-mentioned first seal member 30*a*. The second seal slide surface 13*b* is formed on a lower side of the cam ring reference line, in FIG. 2 and shaped to be always held in sliding contact with a later-mentioned second seal member 30*b*.

The suction port 21*a* is integrally formed with an introduction portion 23 extending radially so as to bulge, from a middle portion of the circumferentially extending suction port 21*a*, toward a later-mentioned spring receiving chamber 28. In the vicinity of the connecting portion between the suction port 21*a* and introduction portion 23, there is formed a suction hole 21*b* extending through the end wall of pump body 11, and opening to the outside. With this construction, the pump 10 functions to suck the oil stored in an oil pan T of the internal combustion engine, by the use of a negative pressure produced by the pumping action of the pump element, through the suction hole 21*b* and suction port 21*a*, into the pumping chamber(s) PR in the suction region. The suction hole 21*a* is connected with the introduction portion 23, and further connected with a lower pressure chamber 35 formed in an outer circumferential region of cam ring 15 in the suction region, and arranged to receive the oil of a lower pressure which is the intake pressure.

The discharge port 22*a* includes a leading end portion formed with a discharge hole 22*b* extending through the end wall of pump body 11 and opening to the outside. With this construction, the pump 10 functions to supply the oil pressurized by the pumping action and discharged to the discharge port 22*a*, from the discharge hole 22*b* through the oil main gallery MG to the various sliding contact portions of the internal combustion engine and the valve timing control apparatus.

A suction port and a discharge port are formed in the inside surface of the pump cover (not shown), too, in the same manner as the suction port 21*a* and discharge port 22*a* formed in the inside surface of the end wall of pump body 11, and arranged to confront axially the suction port 21*a* and discharge port 22*a* of pump body 11.

The drive shaft 14 extends through the end wall of pump body 11, to a shaft end portion connected the crankshaft (not shown). By receiving the rotational force transmitted from the crankshaft, the drive shaft 14 rotates the rotor 16 in the clockwise direction as viewed in FIG. 2. As shown in FIG. 2, a line N (hereinafter referred to as a cam ring eccentric direction line) is an imaginary straight line passing through the center of drive shaft 14 and intersecting the cam ring reference line M at right angles. This cam ring eccentric direction line N serves as a boundary between the suction region and the discharge region.

The rotor 16 includes the slits 16*a* extended radially outwards from a central portion of the rotor. Moreover, rotor 16 is formed with back pressure chambers 16*b* each formed at the radial inner end of one slit 16*a*. In this example, each back pressure chamber 16*b* has an approximately circular cross section. The back pressure chambers 16*b* are arranged to receive the discharge oil pressure. The vanes 17 are pushed radially outwards by the centrifugal force due to the rotation of rotor 16 and the pressure in the back pressure chambers 16*b*.

Each vane 17 includes a forward end sliding on the inside circumferential surface of cam ring 15 and an inner base end sliding on the outer circumferential surfaces of first and second ring members 18. The ring members 18 are arranged to push each vane 17 radially outwards, away from the center of rotor 16, so that the forward end of each vane 17 slides on the inside circumferential surface of cam ring 15 even when the centrifugal force is small and the pressure in the back pressure chambers 16*b* is low at low engine speeds. Thereby, the vanes 17 defines each of the pumping chambers PR liquid-tightly.

The cam ring 15 is an integral member shaped like a hollow cylinder, and made of sintered metallic material. Cam ring 15 includes a pivot portion 26 which extends axially, which is located at a predetermined position in the outer circumferential portion and which is formed in the shape of a substantially circular arc recess fit over the pivot pin 19 to define a fulcrum of eccentric swing motion.

Cam ring 15 further includes an arm portion 27 projecting radially from a portion diametrically opposite to the position of the pivot portion 26, and having a portion abutting on the coil spring 33 which serves as an urging or biasing member and which is set to have a predetermined spring constant. This arm portion 27 is formed with a projection 27*a* formed on one side of arm portion 27 facing in the moving (rotational) direction, in the form of a substantially circular arc projection, and arranged to abut always on the forward end of coil spring 33, and thereby to form a linkage between arm portion 27 and coil spring 33.

A spring receiving chamber 28 for receiving and holding the coil spring 33 is formed in the pump body 11, at a position confronting the support groove 11*b*. The spring receiving chamber 28 extends, along the cam ring eccentric direction N shown in FIG. 2, at the position adjacent to the pump receiving chamber 13. Coil spring 33 is disposed elastically between the end wall or bottom of spring receiving chamber 13 and the arm portion 27 (projection 27*a*), with a predetermined set load W1. The other end wall (upper wall) of spring receiving chamber 28 serves as a regulating portion 29 for regulating the swing range in the eccentric direction of cam ring 15. The regulating portion 29 is arranged to abut on the other (upper) side of arm portion 27 and thereby prevent cam ring 15 from moving further in the eccentric direction.

The set load W1 of coil spring 33 is so set that, in a high pressure region exceeding a maximum or highest engine requirement oil pressure required by the internal combustion engine (a later-mentioned third engine requirement oil pressure Pe3), an operation oil pressure of cam ring 15 (a later-mentioned second operation oil pressure Pc2) is higher than a changeover oil pressure of pilot valve 40 (a later-mentioned second changeover oil pressure Pv2). With this setting, the second operation oil pressure Pc2 of cam ring 15 does not become lower than the second changeover oil pressure Pv2 of pilot valve 40 in any of situations such as dimension error of a spool valve element 43 of pilot valve 40 and nonuniformity of a set load W2 of a valve spring 44 of pilot valve 40. Therefore, this setting is a setting satisfying the later-mentioned third engine requirement oil pressure Pe3 securely.

Figure 3:
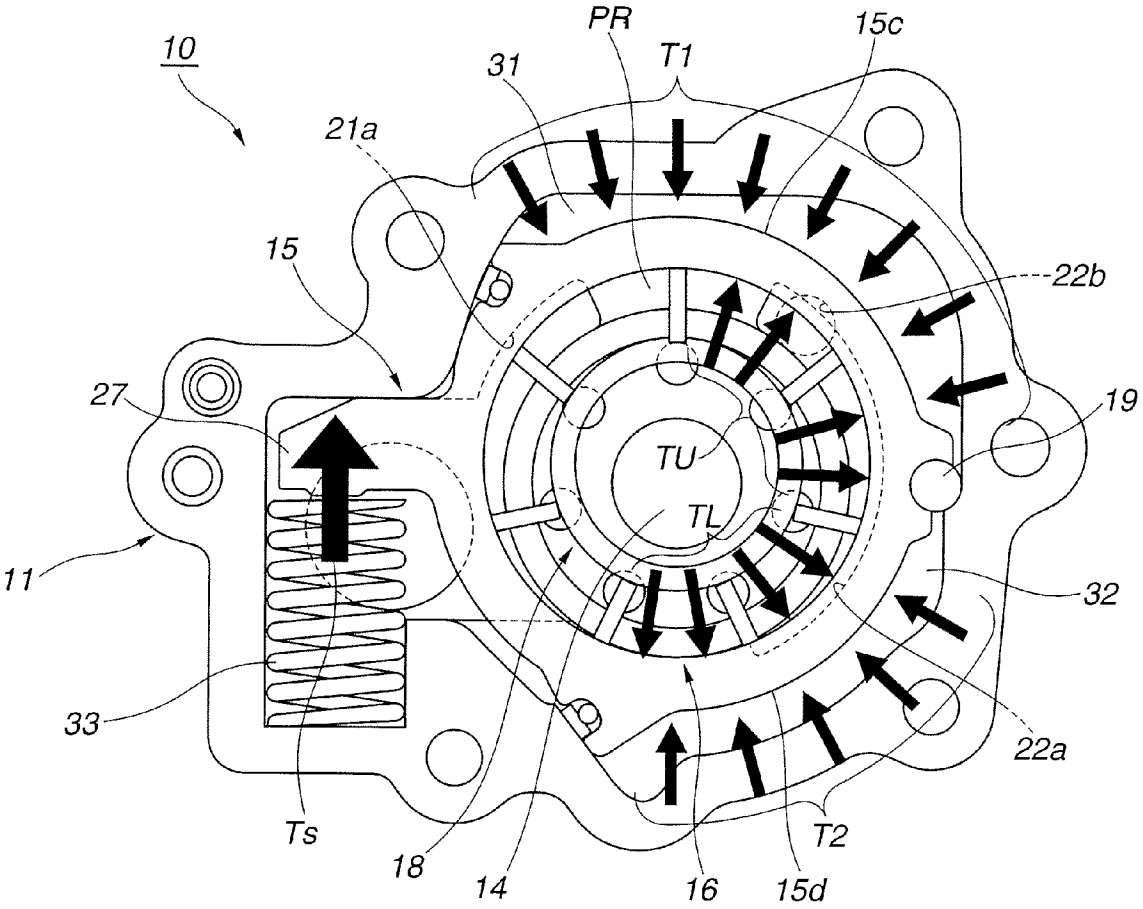
FIG. 3 is a view showing a torque distribution of torques acting on a cam ring of the variable displacement pump shown in FIG. 2.

Thus, cam ring 15 is always urged by an urging force Ts (as shown in FIG. 3) of coil spring 33 through the arm portion 27 in the direction increasing the eccentricity (the clockwise direction in FIG. 1, hereinafter referred to as the eccentric direction). Therefore, in an inoperative state, the cam ring 15 is held in the position at which the other (upper) side of arm portion 27 abuts against the regulating portion 29 and the eccentricity is greatest.

Cam ring 15 includes first and second seal forming portions 15*a* and 15*b* projected, respectively, to have seal surfaces curved in the form of a concentric circular arc with the first and second seal slide surfaces 13*a* and 13*b* formed in the inside circumferential surface of pump receiving chamber 13 of the pump housing (11). First and second seal members 30*a* and 30*b* are retained, respectively, in the seal surfaces of first and second seal forming portions 15*a* and 15*b*. Each seal member 30*a* or 30*b* is a long member of a low friction material such as fluorine resin having a low friction characteristic, extending rectilinearly in the axial direction of cam ring 15. Each of first and second seal members 30*a* and 30*b* is backed up by an elastic member of rubber material, and pressed on the confronting seal slide surface 13*a* or 13*b*, as shown in FIG. 2, to form a liquid tight seal between the seal surface of the seal forming portion 15*a* or 15*b* and the seal slide surface 13*a* or 13*b*.

The first and second control oil or fluid chambers 30*a* and 30*b* are defined around the cam ring 15, by this seal structure. First control oil chamber 31 is defined between the pivot pin 19 and the first seal member 30*a* held by the first seal forming portion 15*a*. Second control oil chamber 32 is defined between the pivot pin 19 and the second seal member 30*b* held by the second seal forming portion 15*b*. The control pressure is introduced into first and second control oil chambers 31 and 32, from a control pressure introduction passage 70 branching off from the oil main gallery MG, as an oil pressure in the engine. Specifically, the control pressure is the oil pressure in the engine resulting from a pressure decrease caused by passage of the pump discharge pressure through an oil filter (not shown). This control oil pressure is introduced into the first control oil chamber 31, through a first introduction passage 71 which is a first branch passage branching off from the control oil pressure introduction passage 70. The control oil pressure is introduced into the second control oil chamber 32, through a second introduction passage 72 (72*a*, 72*b*) which is a second branch passage branching off from the control oil pressure introduction passage 70.

First and second pressure receiving surfaces 15*c* and 15*d* are formed in the outer circumferential surface of cam ring 15 and arranged to face the first and second control oil chambers 31 and 32, respectively. Therefore, cam ring 15 receives a moving force (swing force) by the application of the pressures in the first and second control oil chambers 31 and 32 on the first and second pressure receiving surfaces 15*c* and 15*d*. The pressure receiving area of first pressure receiving surface 15*c* in first control oil chamber 31 is set smaller than the pressure receiving area of second pressure receiving surface 15*d* in second control oil chamber 32. When the same oil pressure is applied to both of first and second pressure receiving surfaces 15*c* and 15, the cam ring 15 is urged as a whole in the direction decreasing the eccentricity (the counterclockwise direction in FIG. 1, hereinafter referred to as the concentric direction).

Therefore, the cam ring 15 receives a torque (Tp) in the concentric direction, and a torque (Tm) in the eccentric direction. As shown in FIG. 3, the concentric direction torque (Tp) is made up of an urging force T1 caused by the internal pressure in first control oil chamber 31 and an urging force TL caused by the internal pressures in pumping chambers PR in the downstream part of the discharge region. The eccentric direction torque (Tm) is made up of the urging force Ts caused by the set load of coil spring 33, an urging force T2 caused by the internal pressure in second control oil chamber 32, and an urging force TU caused by the internal pressures in pumping chambers PR in the upstream part of the discharge region. Since the difference in the pressure receiving area of the pumping chambers PR between the upstream part and the downstream part of the discharge region is small, a resulting force of these urging forces TL and TU due to the internal pressures in pumping chambers PR becomes equal to zero or a very small torque in one direction (the concentric or eccentric direction).

When a resultant force Tt resulting from the urging forces T1 and T2 due to the internal pressures in first and second control oil chambers 31 and 32 is smaller as compared with the set load W1 of coil spring 33, the cam ring 15 is held in a most eccentric state. When the resultant force Tt resulting from the urging forces T1 and T2 due to the internal pressures in first and second control oil chambers 31 and 32 exceeds the set load W1 of coil spring 33, the cam ring 15 is rotated in the concentric direction in accordance with the resultant force Tt of urging forces T1 and T2 of the control pressures in first and second control oil chambers 31 and 32 (as shown in FIG. 7B and FIG. 8B).

Figure 4:
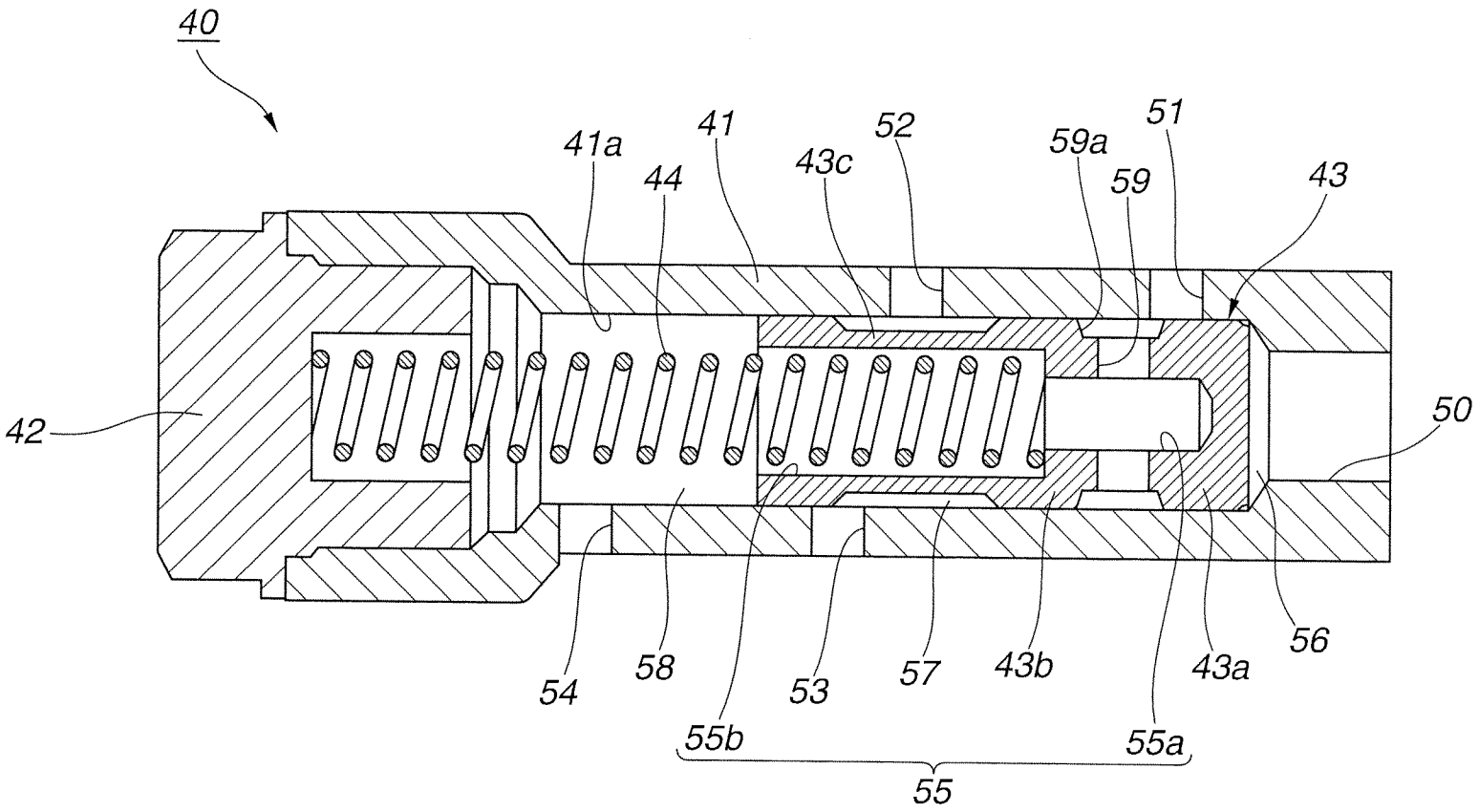
FIG. 4 is an enlarged view of a pilot valve shown in FIG. 1.

The pilot valve 40 includes, as main components, a valve body 41, a spool valve element 43 and a valve spring 44, as shown in FIG. 4. The valve body 41 is shaped like a hollow cylinder extending (axially) from a first axial end portion formed with an introduction or intake port 50, to a second axial end portion whose opening is closed by a plug 42. Through the introduction port 50, pilot valve 50 is connected with the first introduction passage 71. The spool valve element 43 is slidably received in valve body 41, and arranged to control the supply and drainage of the oil pressure for the first and second control oil chambers 31 and 32. Spool valve element 43 includes first and second land portions 43*a* and 43*b* having larger diameter(s) and sliding on the inside circumferential surface of the valve body 41. The valve spring 44 is elastically disposed, in valve body 41, between the plug 42 and the spool valve element 43 with a predetermined set load W2, and arranged to urge the spool valve element 43 toward the first end formed with introduction port 50 always.

The valve body 41 includes a valve receiving portion 41*a* in the form of a cylindrical bore having an inside diameter approximately equal to an outside diameter of spool valve element 43 (the outside diameter of first and second land portions 43*a* and 43*b*), and extending axially between the first axial end portion and the second axial end portion of valve body 41. Spool valve element 43 is slidably received in this valve receiving portion 41*a*. The introduction port 50 is opened in the first axial end portion of valve body 41, and adapted to be connected with first introduction passage 71 to introduce the control pressure from first introduction passage 71 into pilot valve 40. The plug 42 is screwed in a female screw portion or internally threaded portion formed in the inside circumferential surface of the second axial end portion of valve body 41.

The circumferential wall of valve body 41 defining the valve receiving portion 41*a* is formed with first and second connection ports 51 and 52, a supply/discharge port 53 and a drain port 54. The first connection port 51 is opened at a first axial position near the first end portion (50) and adapted to be connected with first control oil chamber 31. The second connection port 52 is opened at a second axial position (or intermediate position) near the axial middle of the circumferential wall and adapted to be connected with second control oil chamber 32. The supply/discharge port 53 is opened at a third axial position (near the second axial position) and adapted to be connected with the solenoid valve 60 through a downward passage 72*b* which is a downward segment of the second introduction passage 72 (as shown in FIG. 1), for the supply/discharge of the control oil for the second control oil chamber 32. The drain port 54 is opened at a fourth axial position near the second axial end portion (42) and arranged to drain the oil pressure conveyed through a later-mentioned inside passage 55 of spool valve element 43 from the first and second control oil chambers 31 and 32.

The spool valve element 43 includes a smaller diameter shaft portion 43*c* connecting the first and second land portions 43*a* and 43*b* which are formed, respectively at both ends. In the valve receiving portion 41*a* of valve body 41, the spool valve element 43 defines a pressure chamber 56, a relay chamber 57 and a back pressure chamber 58. The pressure chamber 56 is formed between the first land portion 43*a* and valve body 41, and arranged to receive the control pressure through introduction port 50. The relay chamber 57 is formed between first and second land portions 43*a* and 43*b*, and arranged to serve as a portion for relay between the second connection port 52 and the supply/discharge port 53. The back pressure chamber 58 is formed between the second land portion 43*b* and plug 42, and arranged to drain the oil pressure conveyed through the inside passage 55.

Spool valve element 43 further includes the inside passage 55 extending axially from the second end of spool valve element 43 (closer to plug 42), having a stepped shape decreasing the inside diameter stepwise toward the first end (closer to introduction port 50), and serving as a passage for discharging the oil pressure in first control oil chamber 31. Specifically, inside passage 55 includes a small diameter section 55*a* near the first end and a large diameter section 55*b* extending from the second end of spool valve element 43 to the small diameter section 55*a* and receiving a first end portion of valve spring 44. The small diameter section 55*a* is connected with the first connection port 51 through an annular groove 59*a* and a plurality of radial holes 59 extending to the annular groove 59*a* from the small diameter section 55*a* in the state in which spool valve element 43 is at an upper end position near the first end as shown in FIG. 4 (or FIG. 1). In the state in which spool valve element 43 is at a lower end position as shown in FIG. 8B, the small diameter section 55*a* is disconnected from the first connection port 51. The large diameter section 55*b* is connected with back pressure chamber 58 through the inside space of coil spring 44 received in large diameter section 55*b*.

The thus-constructed pilot valve 40 assumes the following states in dependence on the control pressure introduced into the pressure chamber 56 through introduction port 50. When the control pressure introduced into pressure chamber 56 through introduction port 50 is lower than or equal to a predetermined first changeover pressure Pv1, the spool valve element 43 is pushed by valve spring 44 toward the first end of valve receiving portion 41*a*, and located at a first position (or first select or valve position) in a predetermined range on the first end's side of valve receiving portion 41*a* (cf. FIG. 7A). At the first position of spool valve element 43, the first land portion 43*a* closes first connection port 51, and disconnects first connection port 51 from introduction port 50, and the relay chamber 57 connects second connection port 52 with the supply/discharge port 53.

Figure 7A:
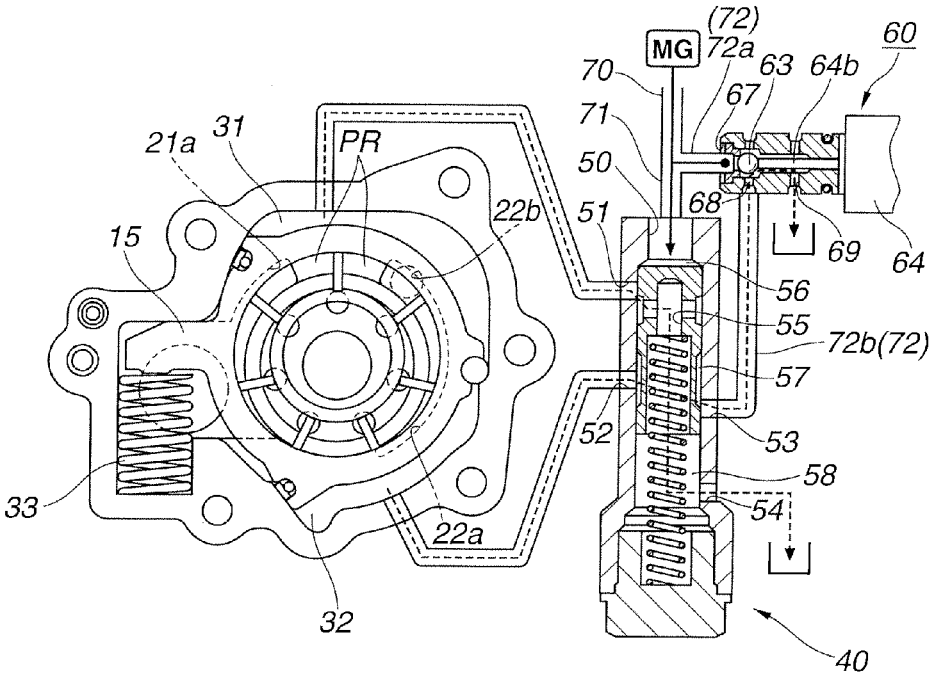
FIG. 7A is a hydraulic circuit diagram showing the variable displacement pump according to this embodiment in a state in an interval "a" shown in FIG. 6.
Figure 7B:
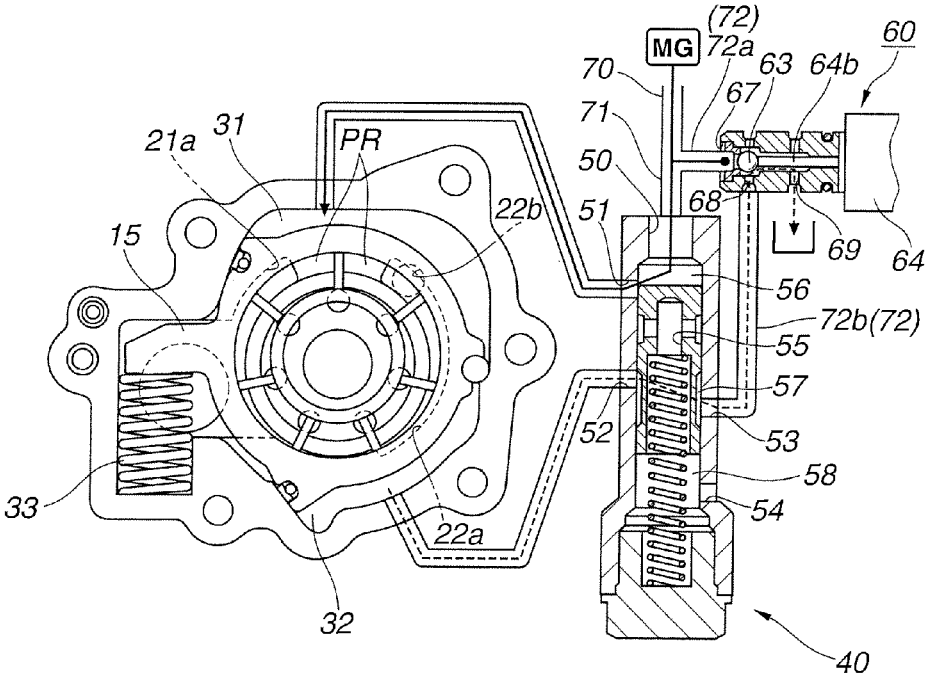
FIG. 7B is a hydraulic circuit diagram showing the variable displacement pump according to this embodiment in a state in an interval "b" shown in FIG. 6.
Figure 8A:
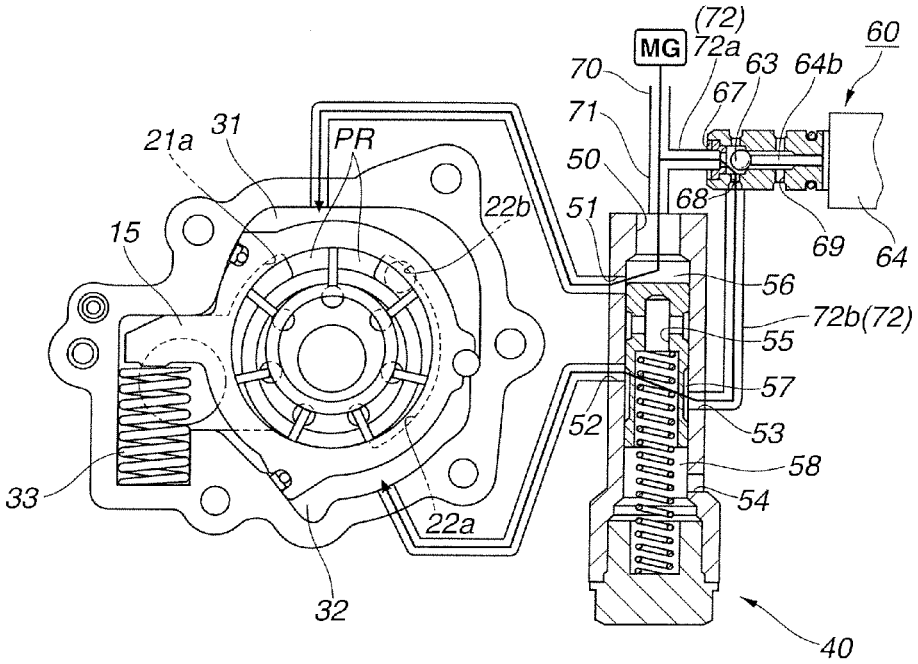
FIG. 8A is a hydraulic circuit diagram showing the variable displacement pump according to this embodiment in a state in an interval "c" shown in FIG. 6.
Figure 8B:
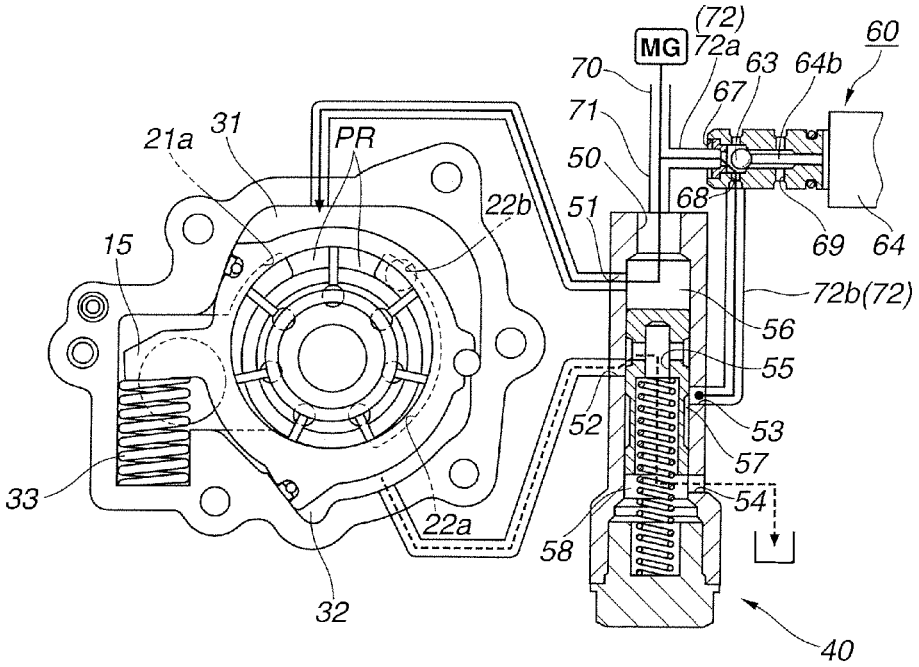
FIG. 8B is a hydraulic circuit diagram showing the variable displacement pump according to this embodiment in a state in an interval "d" shown in FIG. 6.
Figure 9:
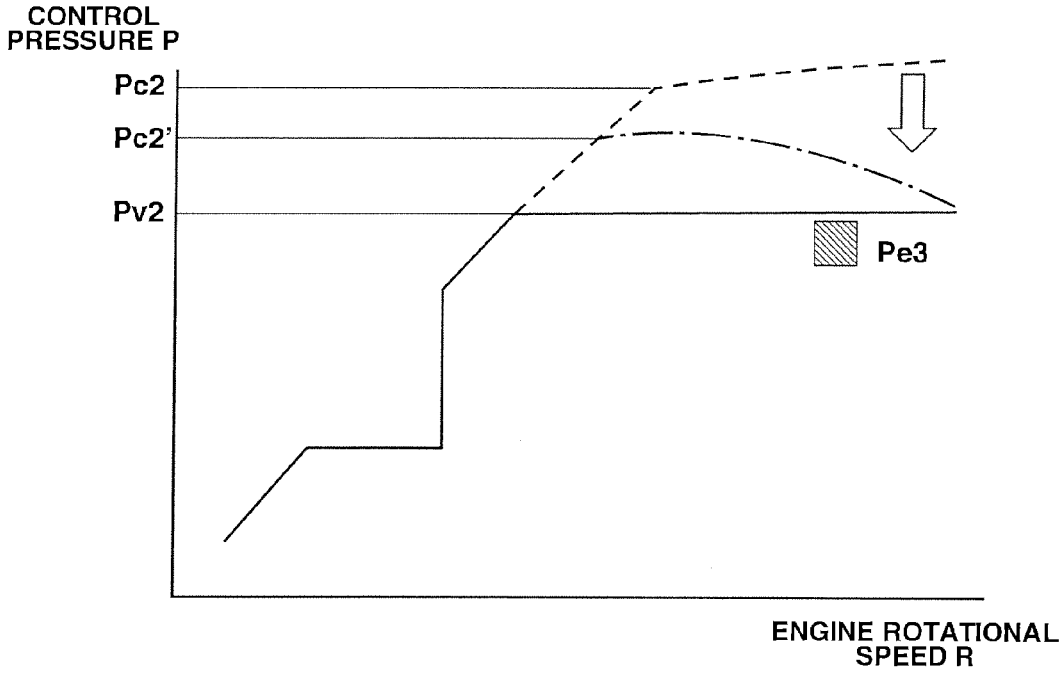
FIG. 9 is a view similar to FIG. 6, for illustrating the effect of the variable displacement pump according to this embodiment.

When the control pressure introduced into pressure chamber 56 becomes higher than the first changeover pressure Pv1, the spool valve element 43 moves, against the urging force of valve spring 44, from the first position, in a direction toward the second end of valve receiving portion 41*a*, to a second position (or second select or valve position) which is a middle or intermediate position in valve receiving portion 41*a* (cf. FIG. 7A, FIG. 8A). At the second position of spool valve element 43, the first land portion 43*a* overlaps the first connection port 51 and thereby forms a throttle (V), so that first connection port 51 is connected with the introduction port 52 through the pressure chamber 56 by this throttle, and the relay chamber 57 holds the connection between second connection port 52 and supply/discharge port 53.

When the control pressure introduced into pressure chamber 56 becomes higher than a second changeover pressure Pv2, the spool valve element 43 further moves, against the urging force of valve spring 44, from the second position, in the direction toward the second end of valve receiving portion 41*a*, to a third position in a predetermined range near the second end of valve receiving portion 41*a* (cf. FIG. 8B). At the third position, the first land portion 43*a* opens the first connection port 51 widely and connects first connection port 51 fully with introduction port 50 through pressure chamber 56, and the second land portion 43*b* breaks the connection between second connection port 52 and supply/discharge port 53 through relay chamber 57, and makes a connection between second connection port 52 and drain port 54 through inside passage 55.

Figure 5:
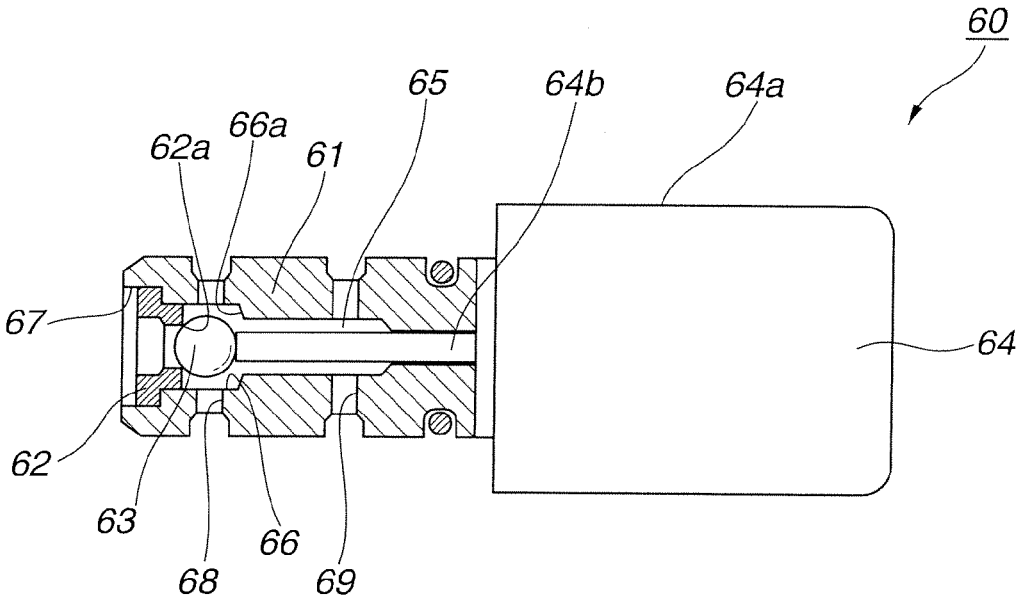
FIG. 5 is an enlarged view of a solenoid valve shown in FIG. 1.

The solenoid valve 60 is received in a valve receiving hole (not shown) provided in the second introduction passage 72 at an intermediate position between both ends of second introduction passage 72. As shown in FIG. 5, the solenoid valve 60 includes a valve body 61, a seat member 62, a ball valve element 63 and a solenoid 64, as main components. The valve body 61 is a hollow cylindrical member having an inside axial passage 65 extending through valve body 61. Valve body 61 includes a valve element receiving portion 66 formed by enlarging a part of inside axial passage 65 to have a larger diameter, in a first end portion of valve body 61 near a first end of valve body 61 (the left side end as viewed in FIG. 5, retaining the seat member 62). The seat member 62 is press fit and fixed in an outer end or first (or left side) end portion of the valve element receiving portion 66. Seat member 62 includes a center opening defining an introduction port 67 which is an upstream opening connected with an upstream passage 72*a* of second introduction passage 72. The upstream passage 72*a* is an upstream segment of second introduction passage 72, as shown in FIG. 1. A valve seat 62*a* is formed in an inner open end of seat member 62. The ball valve element 63 is disposed to be seated on and moved away from, the valve seat 62*a*, and arranged to open or close the introduction port 67. The solenoid 64 is provided in a second end portion of valve body 61 (a right end portion as viewed in FIG. 5).

The valve element receiving portion 66 is formed in the first (left side) end portion of valve body 61 to receive the ball valve element 63, and shaped to have a stepped enlarge shape having an inside diameter or dimension greater than the inside diameter or dimension of inside axial passage 65. A step (annular step) formed between the valve element receiving portion 66 and the inside axial passage 65 is formed as a valve seat 66*a* which is similar to the valve seat 62*a* formed in seat member 62, and which confronts axially the valve seat 62*a*. The circumferential wall of valve body 61 is formed with a supply/discharge port 68 and a drain port 69. The supply/discharge port 68 is opened near the forward or first end (left end in FIG. 5) radially, into the valve element receiving portion 66, and connected with the downstream passage 72*b* for supply and drainage of the oil pressure for pilot valve 40. The drain port 69 is opened radially into the inside axial passage 65, at a position closer to the position of solenoid 60, and connected to the oil pan T.

The solenoid 64 includes a coil (not shown) in a casing 64*a*. With an electromagnetic force produced by energization to the coil, the solenoid 64 moves an armature (not shown) disposed in the coil and a rod 64*b* fixed with the armature leftward as viewed in FIG. 5. Solenoid 64 receives the exciting current in accordance with engine operation condition(s) calculated or sensed from parameters such as an oil temperature, a water temperature and the rotational speed of the internal combustion engine, under the control of an ECU (not shown) mounted in the vehicle.

The thus-constructed solenoid valve 60 is operated in the following manner. When the solenoid 64 is energized, the solenoid moves the rod 64*b* outwards (leftwards) and presses the ball valve element 63 with the forward end of rod 64*b* against the valve seat 62*a* of seat member 62. Therefore, the ball valve element 63 closes the introduction port 67 to break the connection between introduction port 67 and supply/discharge port 68, and the inside axial passage 65 connects the supply/discharge port 68 with drain port 69. When the solenoid 64 is not energized, the ball valve element 63 is moved backwards (rightward) by the control pressure introduced from the introduction port 67, and pressed against the valve seat 66*a* of valve body 61. Therefore, the introduction port 67 is connected with the supply/discharge port 68, and the supply/discharge port 68 is disconnected from the drain port 69.

FIG. 6~11 are views for illustrating characteristic operations of the oil pump 10 according to this embodiment.

Figure 6:
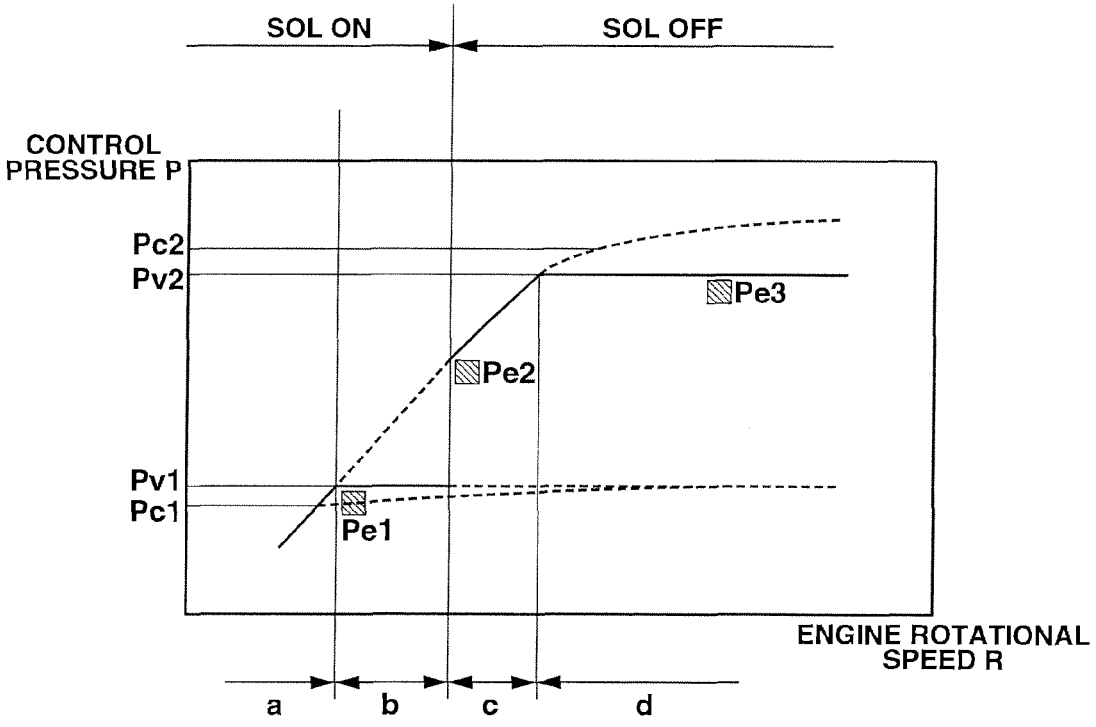
FIG. 6 is a graphic view showing an oil pressure characteristic of the variable displacement pump according to this embodiment.

First, FIG. 6 is used for explaining required oil pressures or requirement oil pressures of the internal combustion engine which are used as references for the discharge pressure control of the oil pump 10. The example of FIG. 6 employs three engine requirement pressures which are oil pressures required by the engine. In FIG. 6, a first engine requirement pressure Pe1 is an oil pressure corresponding to an oil pressure required by a valve timing control device in the case of the internal combustion engine provided with the valve timing control device for improving the fuel consumption. A second engine requirement pressure Pe2 is an oil pressure required by an oil jet for cooling the piston(s) in the case of the engine provided with the piston cooling oil jet device. The before-mentioned third engine requirement pressure Pe3 is an oil pressure required for lubrication of bearing portions of the crankshaft at high engine speeds. A solid line connecting the points of Pe1, Pe2 and Pe3 in FIG. 6 represents an ideal oil pressure (control pressure) varying with engine speed R of the internal combustion engine. A broken line in FIG. 6 represents an actual oil pressure characteristic of the oil pump.

In FIG. 6, the first changeover oil pressure Pv1 is an oil pressure at which the spool valve element 43 starts moving from the first position to the second position against the urging force caused by the set load W1 of valve spring 44. The second changeover oil pressure Pv2 is an oil pressure at which the spool valve element 43 starts moving from the second position to the third position against the urging force of valve spring 44.

In an interval or region "a" corresponding to an engine speed region from a start of the engine to a low engine speed in a low speed region as shown in FIG. 6, the control pressure P is lower than the first changeover pressure Pv1, and hence the spool valve element 43 of pilot valve 40 is located at the first position at which the first connection port 51 is disconnected from pressure chamber 56 by first land portion 43*a*, and instead connected with the inside axial passage 55, and the second connection port 52 is connected through relay chamber 57 with the supply/discharge port 53. as shown in FIG. 7A. Furthermore in this engine speed region, the solenoid 64 is supplied with the exciting current, and hence the solenoid valve 60 is put in the state the introduction port 67 is disconnected from the supply/discharge port 68, and the supply/discharge port 68 is connected with the drain port 69. Therefore, the oil in first control oil chamber 31 is discharged to oil pan T through the inside passage 55 and drain port 54, and the oil in second control oil chamber 32 is also discharged to oil pan T through relay chamber 57, supply/discharge port 53 and solenoid valve 60, so that first and second control oil chamber 31 and 32 receive no oil pressure, and the internal pressures in first and second control oil chambers 31 and 32 are equal to the atmospheric pressure. As a result, the control pressure P is lower than the first operation pressure Pc1, the cam ring 15 is held in the greatest eccentricity state, and the control pressure P is increased substantially in proportion to the engine speed R.

When the engine speed R increases and the control pressure P reaches the first changeover pressure Pv1 shown in FIG. 6, then, the solenoid 64 of solenoid valve 60 is held energized, and the spool valve element 42 in pilot valve 40 moves slightly toward plug 42 against the urging force of valve spring 44, and by so doing moves from the first position to the second position as shown in FIG. 7B. Therefore, the pilot valve 40 is put in the state in which the first connection port 51 is disconnected from the inside passage 55 by first land portion 43*a* and instead connected slightly with pressure chamber 56, and the second connection port 52 is connected with oil pan T through relay chamber 57 as in the interval "a". Therefore, the first control chamber 31 receives a control pressure Px slightly lowered from the first changeover pressure Pv1 introduced through a throttle V formed by overlap of first connection port 51 and first land portion 43*a*. The second control oil chamber 32 is held in no oil pressure state in which the oil is discharged from second control oil chamber 32 to oil pan T. Consequently, the urging force T1 caused by the internal pressure in first control oil chamber 31 overcomes the urging force Ts of coil spring 33 because the first operation pressure Pc1 is set lower than first changeover pressure Pv1, and the above-mentioned pressure Px is at a level capable of causing the operation, and the cam ring 15 moves slightly in the concentric direction.

Then, the decrease of eccentricity of cam ring 15 due to movement of cam ring 15 in the concentric direction causes the control pressure P to decrease and become lower than the first changeover pressure Pv1. Consequently, the spool valve element 43 in pilot valve 40 is pushed back by the urging force of valve spring 44 from the second position to the first position. Therefore, as mentioned before, the oil in first control oil chamber 31 is discharged, the urging force T1 due to the internal pressure of first control oil chamber 31 becomes smaller than the urging force Ts of coil spring 33, and cam ring 1 is brought again to the state of the greatest eccentricity as shown in FIG. 7A.

Thus, the connection state of first connection port 51 leading to first control oil chamber 31 is changed over repeatedly by the spool valve element 43 between the connection of first connection port 51 with the introduction port 50 though pressure chamber 56 and the connection of first connection port 51 with drain port 54 through inside passage 55. Therefore, pilot valve 40 adjusts the control pressure P so as to hold the control pressure P at the level of first changeover pressure Pv1, and hence the characteristic of control pressure P of oil pump 10 becomes substantially flat (as shown in the interval "b" in FIG. 6).

When the engine speed R further increases in the state in which spool valve element 43 of pilot valve 40 is in the second position, as shown in FIG. 8A, first the solenoid 64 is deenergized, so that the introduction port 67 is connected with the supply/discharge port 68, and the supply/discharge portion 68 is disconnected from drain port 69. Since the control pressure P is still lower than second changeover pressure Pv2, and hence the spool valve element 43 is held at the first position, the pilot valve 40 is put in the state in which the first connection port 51 is connected with introduction port 50 through pressure chamber 56 and the second connection port 52 is connected with supply/discharge port 53 through relay chamber 57. Therefore, the control pressure Px reduced by the throttle V formed by first land portion 43*a* is supplied to first control oil chamber 31, and the control pressure P is supplied through second introduction passage 8*b* to second control oil chamber 32. Therefore, the urging force Tm in the eccentric direction resulting from the urging force Ts of coil spring 33 and the urging force T2 of the internal pressure in second control oil chamber 32 becomes greater than the urging force T1 of the internal pressure in first control oil chamber 31 in the concentric direction. Consequently the cam ring 15 is pushed back in the eccentric direction and the control pressure increases again with a greater rate (the interval "c" in FIG. 6).

When the control pressure P increases with this increasing characteristic and reaches the second changeover pressure Pv2 (shown in FIG. 6), then, as shown in FIG. 8B, the solenoid 64 remains deenergized, and the spool valve element 43 in pilot valve moves toward plug 42 by the control pressure P introduced into pressure chamber 56 through introduction port 50, against the urging force of valve spring 44, and thereby moves from the second position to the third position. Therefore, the first connection port 51 is connected through a sufficiently wide opening, with introduction port 50 via pressure chamber 56, and the second connection port 52 is disconnected from relay chamber 57 by second land portion 43*b* and instead connected through inside passage 55 with drain port 54. As a result, the oil pressure is supplied sufficiently to first control oil chamber 31 and the oil is drained from second control oil chamber 32 through inside passage 55 and drain port 54 to oil pan T, so that the hydraulic pressure is applied only in first control oil chamber 31. Therefore, the urging force T1 by the internal pressure in first control oil chamber 31 in the concentric direction exceeds the urging force Ts of coil spring 33 in the eccentric direction, and cam ring 15 moves in the concentric direction.

With this movement of cam ring 15 in the concentric direction, the control pressure P is decreased by the decrease of the eccentricity of cam ring 15, and the control pressure P becomes lower than second changeover pressure Pv2. As a result, spool valve element 43 is pushed back by the urging force of valve spring 44 from the third position to the second position. Therefore, as mentioned before, the control pressure P is supplied again into second control oil chamber 32. Therefore, the urging force Tm in the eccentric direction resulting from urging force Ts of coil spring 33 and urging force T2 of the internal pressure in second control oil chamber 32 becomes greater than the urging force T1 of the internal pressure in first control oil chamber 31 in the concentric direction. Consequently the cam ring 15 is pushed back in the eccentric direction (FIG. 8A) and the control pressure P increases with a greater rate.

Thus, the connection state of second connection port 52 leading to second control oil chamber 32 is changed over repeatedly by the spool valve element 43 between the connection of second connection port 52 with the supply/discharge port 53 (introduction port 67) through relay chamber 57 and the connection of second connection port 52 with drain port 54 through inside Passage 55. Therefore, pilot valve 40 adjusts the control pressure P so as to hold the control pressure P at the level of second changeover pressure Pv2, and hence the characteristic of control pressure P of oil pump 10 becomes substantially flat (as shown in the interval "d" in FIG. 6).

In the earlier technology, in the swing motion control of the cam ring, no consideration is given to a decrease of the internal pressures in the pumping chambers PR due to aeration or involvement of air voids in the oil sucked into the pumping chambers PR. Therefore the air voids mixed in the oil during the suction causes a decrease of the modulus of volume elasticity of the oil and causes the oil to have compressibility. Consequently, in the compression process in the discharge region following the expansion process in the suction region, merely the air voids are compressed in the pumping chambers PR and the internal pressures in the pumping chambers are not increased directly. Accordingly, the urging force TL based on the internal pressures of the pumping chambers PR in the downstream part of the discharge region becomes greater than the urging force TU based on the internal pressures of the pumping chambers PR in the upstream art of the discharge region.

Figure 12:
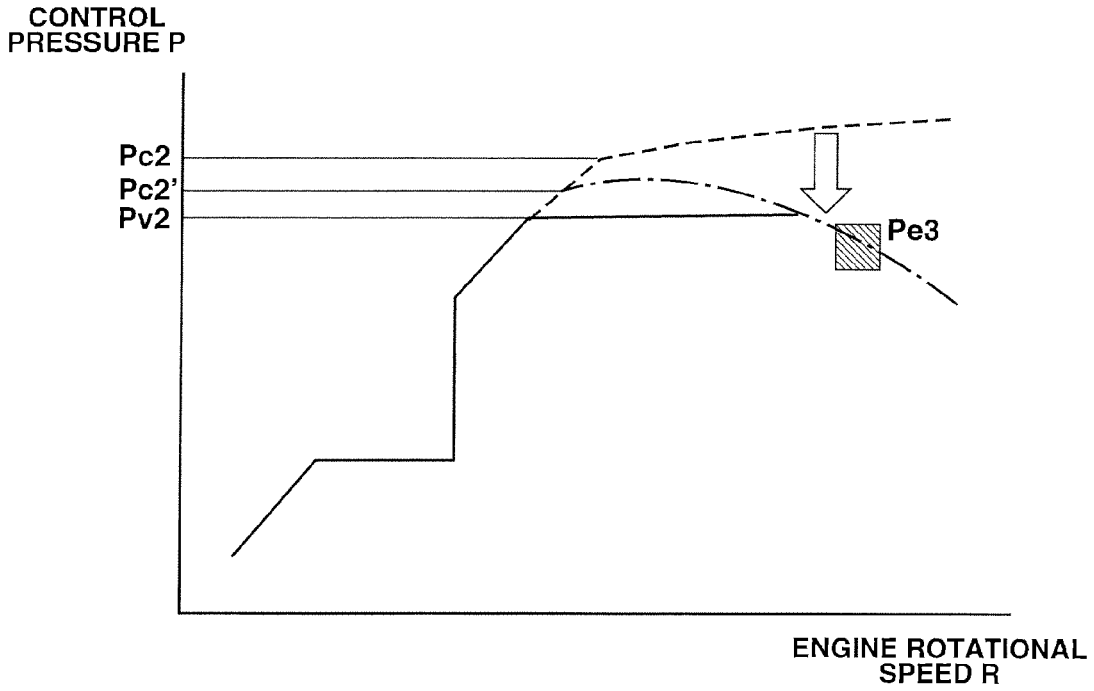
FIG. 12 is a view similar to FIG. 9, for illustrating the effect of a variable displacement pump of a comparative example.

This relative increase of the urging force TL acting in the concentric direction, due to the internal pressures of the pumping chambers PR on the downstream side in the discharge region makes the torque Tp in the concentric direction greater than the torque Tm in the eccentric direction. Therefore, the second operation oil pressure Pc2 is decreased to a value Pc2', as shown by a one-dot chain line in FIG. 12, in comparison with the condition free of the aeration (as shown by a broken line in FIG. 12). Therefore, in the high speed region, the pump might be unable to satisfy the third engine requirement oil pressure Pe3 or the maximum engine requirement oil pressure.

Moreover, though the internal pressure in each pumping chamber PR tends to be increased by a backward flow of the oil pressure from the discharge port 22*a*, the pumping chambers PR rotate with their internal pressures remaining low and the lower pressure region expands when the rotational speed is higher in the high engine speed region. As a result, with increase of the engine speed, the concentric direction urging force TL caused by the internal pressures in the pumping chambers PR in the downstream part of the discharge region becomes higher as compared to the eccentric direction urging force TU, and the second operation oil pressure Pc2 is further decreased.

By contrast, in the oil pump 10 according to this embodiment, in consideration of the decrease of the pressure in each pumping chamber PR due to the aeration, the second operation pressure Pc2 is higher than the second changeover pressure Pv2 where the second operation pressure Pc2 is an operation pressure of cam ring 15 in the high pressure region exceeding the third or maximum engine requirement pressure Pe3, and the second changeover pressure Pv2 is an operation pressure of pilot valve 40. Therefore, the oil pump 10 can attain the third or maximum engine requirement pressure Pe3 even when the internal pressures in the pumping chambers PR become lower due to the aeration as shown by the one-dot chain line in FIG. 9, and hence the discharge pressure (control pressure) is decreased by the decrease of the eccentricity of cam ring 15 due to the decrease of the internal pressures in the pumping chambers PR, as well as when there is no aeration as shown by the broken line in FIG. 9.

In this way, with the setting of the second operation pressure Pc2 in the high pressure region exceeding the highest or third engine requirement pressure Pe3*t*, higher than the second changeover pressure Pv2 of pilot valve 40, the oil pump 10 according to this embodiment can satisfy the highest or third engine requirement pressure Pe3 even if the discharge pressure (control pressure) is decreased by aeration, and secure the proper performance of the internal combustion engine.

Moreover, the operation pressures Pc2 and Pv2 of cam ring 15 and pilot valve 40 can be set by two urging or biasing members in the form of coil spring 33 and valve spring 44. Therefore, the setting of the relationship between the operation pressures Pc2 and Pv2 is easy and advantageous for securing the satisfactory productivity of oil pumps and reducing the production cost.

Furthermore, the oil pump 10 of the illustrated embodiment has a two-step characteristic holding the first operation pressure Pc1 in a predetermined low or lower engine speed region, and holding the second operation pressure Pc2 higher than the first operation pressure in a predetermined high or higher engine speed region, as to the operation of cam ring 15, and the oil pump 10 is arranged to satisfy the maximum engine requirement pressure Pe3 in the high engine speed region. Accordingly, the oil pump 10 can prevent a decrease in the discharge pressure (control pressure) especially in the high rotational speed region in which the operation pressure of cam ring 15 tends to become lower.

In this embodiment, the adjustment of the second operation pressure Pc2 is achieved by adjusting the set loads W1 and W2 of coil spring 33 and valve spring 44. However, the adjustment of the second operation pressure Pc2 can be achieved by various other means. For example, the adjustment of the second operation pressure Pc2 can be achieved by adjusting a pressure receiving area difference between the pressure receiving area of first pressure receiving surface 15*c* of first control oil chamber 31 and the pressure receiving area of pressure receiving surface 15*d* of the second control chamber 32. These pressure receiving areas can be set flexibly in accordance with various parameters such as specification data items of the pump and the vehicle to employ the pump. When the relationship of the operation oil pressure Pc2 with respect to the operation pressure Pv2 is adjusted by the pressure receiving area difference between the pressure receiving surfaces 15*c* and 15*d*, the desired setting of operation pressure Pc2 of cam ring 15 can be achieved without the need for changing the set loads W1 and W2 of springs 33 and 44.

Figure 10:
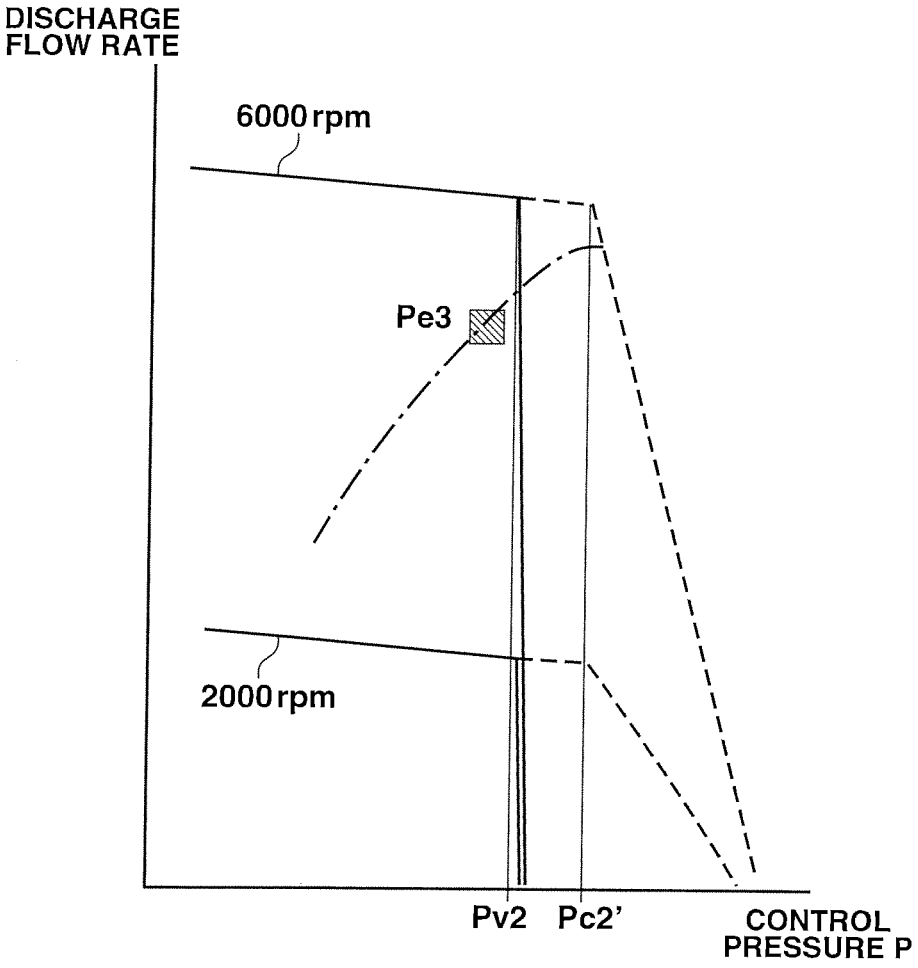
FIG. 10 is a view of a pressure-flow characteristic at the time of occurrence of aeration in the variable displacement pump according to the present invention.
Figure 11:
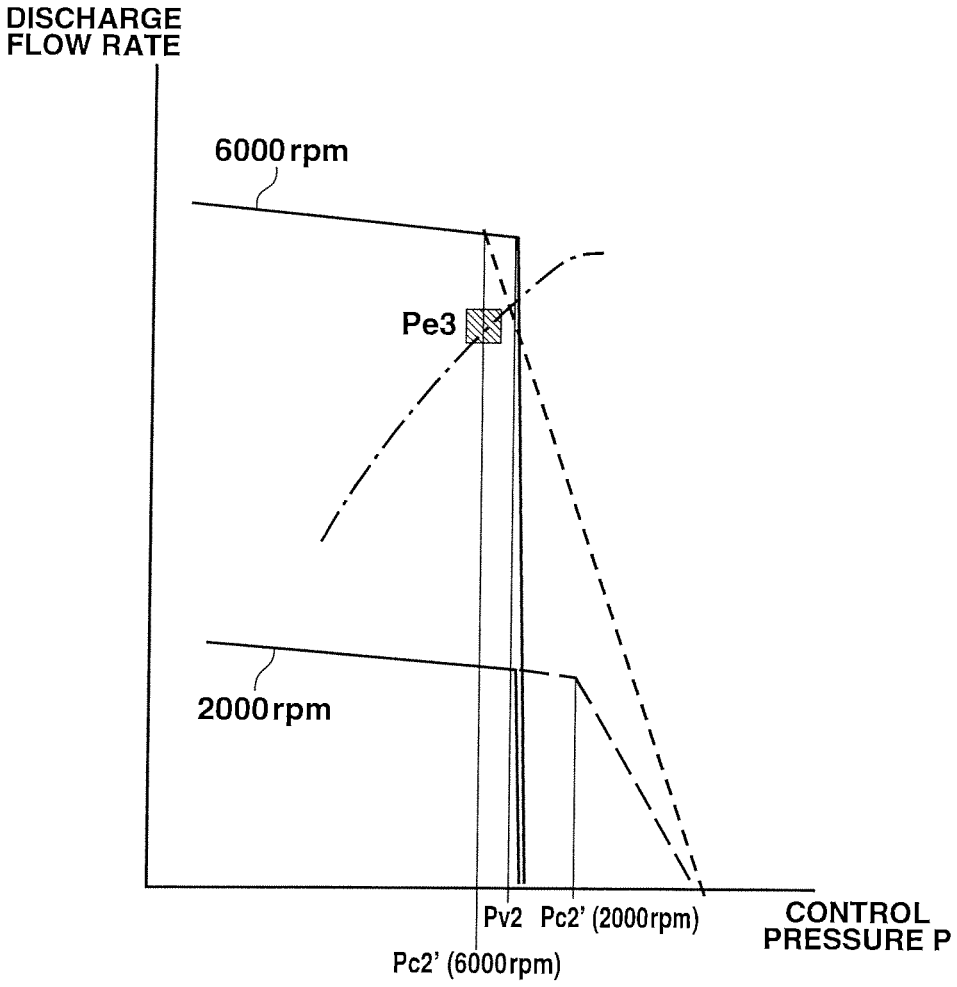
FIG. 11 is a view of a pressure-flow characteristic at the time of occurrence of aeration in the variable displacement pump in another example according to the present invention.

FIGS. 10 and 11 are views showing pressure-flow characteristics at the time of occurrence of aeration in examples of the variable displacement pump according to the present invention. In each of these views, a solid line represents a characteristic in the state free from aeration, a broken line represents a characteristic in the state suffering aeration, a one-dot chain line is an engine resistance line representing a resistance in the engine. In the example of FIG. 10, the second operation pressure Pc2' at the time of occurrence of aeration is invariably higher than the third engine requirement oil pressure Pe3. In the example of FIG. 11, the second operation pressure Pc2' at the time of occurrence of aeration may become lower than or equal to the third engine requirement oil pressure Pe3, but the third engine requirement oil pressure Pe3 can be satisfied because the discharge flow rate is sufficient to afford to satisfy the requirement. The example of FIG. 11 is included in the purview of the present invention as well as the example of FIG. 10.

Besides the oil pump 10 in the illustrated example, the present invention is applicable to various other oil pumps having different cam ring control structures. For example, the present invention is applicable to an oil pump having first and second springs 33 and 34 serving as a pair of coil springs for controlling the swing motion of a cam ring, as shown in FIG. 4 of JP2013-130090A (corresponding to US2013/164162A). This figure and related explanation of this patent document are herein incorporated by reference. In the oil pump having the first and second springs 33 and 34, by adjusting the urging forces of the first and second springs 33 and 34 and the valve spring 44 of the pilot valve and/or adjusting the areas of the pressure receiving surfaces 15*j* and 15*k*, it is possible to set the second operation pressure (Pc2) in the higher pressure region higher than the third engine requirement pressure Pe3, higher than the second changeover pressure Pv2 of a changeover control valve 40 in consideration of decrease of the oil pressure in the pumping chambers due to aeration, and thereby to achieve the effects and operations of the present invention as mentioned before.

The present invention is not limited to the illustrated examples. Various modifications and variations are possible within the purview of the present invention. For example, the engine requirement oil pressures Pe1~Pe3, the first and second changeover oil pressures Pv1 and Pv2, and the structures and the arrangement of the oil passages of pilot valve 40 and solenoid valve 60 can be modified or varied flexibly in accordance with specification date items or parameters of the internal combustion engine of the vehicle in which the oil pump is installed, and the valve timing control apparatus or other apparatus.

In the illustrated example, the variable displacement pump is arranged to vary the discharge quantity by swing motion of the cam ring 15. However, the varying means or mechanism to vary the discharge quantity is not limited to the means based on the swing motion. For example, the varying means may be configured to increase and decrease the discharge quantity or a pumping volume variation quantity of the pumping chambers PR (or a displacement or amount of fluid pumped per revolution), with rectilinear movement of the movable member or cam ring 15 in the radial direction. The motion of the movable member or the cam ring 15 is not limited to the swing motion.

In the illustrated example, the variable displacement oil pump is a variable displacement vane pump employing the cam ring 15 as the movable member to vary the displacement. However, the present invention is not limited to the vane pump. It is possible to employ various other types of the variable displacement oil pump. For example, the variable displacement oil pump according to the present invention may be a trochoid pump. In this case, an outer rotor forming an external gear corresponds to the movable member instead of the cam ring 15. The outer rotor is disposed in a manner enabling eccentric motion, and there are provided, around the outer rotor, the control oil chamber(s) and spring(s) to vary the position of the movable member.

In one of possible interpretations, a variable displacement oil pump according to the present invention comprises a basic structure comprising: a pump or pumping element to vary inside volumes of pumping chambers to suck the oil through a suction portion or suction port and to discharge the oil through a discharge portion or discharge port; a varying mechanism or varying section or means to increase and decrease a pumping volume variation quantity (or displacement or amount of fluid pumped per revolution), with movement of a movable member (such as a cam ring of a vane pump or an outer rotor of a trochoid pump); an urging mechanism or urging section or means to urge the movable member in an increasing direction to increase the pumping volume variation quantity (such as an eccentric direction increasing the eccentricity of the cam ring); a housing member or housing section or means (11, 30*a*, 30*b*) to define a first control oil chamber to receive the oil discharged from the discharge portion and thereby to produce an urging force to urge the movable member in a decreasing direction to decrease the pumping volume variation quantity (such as a concentric direction decreasing the eccentricity of the cam ring), and a second control oil chamber to receive the oil discharged from the discharge portion and thereby to produce an urging force to urge the movable member in a direction to vary the pumping volume variation quantity; and a pressure control section or mechanism or means to control at least one of pressures in the first and second control oil chambers. The variable displacement oil pump according to the present invention may have any one or more of following features.

First feature; an operation oil pressure of the movable member is set higher than an operation oil pressure of the pressure control section at least in a predetermined operating region. Second feature; an operation oil pressure of a cam ring included in the varying mechanism is set to satisfy a maximum or highest engine requirement oil pressure required by the internal combustion engine in consideration of resistance in the internal combustion engine. Third feature; the pressure control section is configured to control the pressures in the first and second control oil chambers to hold the discharge pressure of the oil pump at a predetermined higher pressure level (Pc2, for example) in a predetermined first engine operating region (such as a predetermined higher engine speed region). Fourth feature; the pressure control section is configured to control the pressures in the first and second control oil chambers to hold the discharge pressure of the oil pump at a predetermined lower pressure level in a predetermined second engine operating region (such as a predetermined lower engine speed region).

Fifth feature; the pressure control section is arranged to receive, as a control pressure (P), the discharge pressure of the oil pump through an introduction section or an introduction passage, and to assume an operative state (or fourth) state (such as the state shown in FIG. 8B) to supply the control pressure to the first control oil chamber (or to supply the control pressure only to the first control oil chamber and drain the second control oil chamber) (to urge the movable member in the decreasing direction) when the control pressure (P) becomes equal to or higher than a predetermined changeover pressure (such as Pv2) (or the operation oil pressure of the pressure control section) and an inoperative state (or third) state (such as the state shown in FIG. 8A) to supply the control pressure to the first control oil chamber (through a limited opening or throttled opening V in the illustrated example) and to supply the control pressure to the second control oil chamber (to urge the movable member in the increasing direction) when the control pressure (P) is lower than the predetermined changeover pressure (such as Pv2). Sixth feature; the movable member (such as cam ring 15) is arranged to move from an inoperative position (such as the position of cam ring 15 shown in FIG. 8A or FIG. 7A) to an operative position (such as the position of cam ring 15 shown in FIG. 8B or FIG. 7B) when the control pressure (P) supplied into the first control oil chamber becomes higher than a predetermined operation pressure (such as Pc2)(or the operation oil pressure of the movable member) which is set higher than the predetermined changeover pressure (such as Pv2). Seventh feature; the movable member is arranged to be held in an inoperative position (such as the position of cam ring 15 shown in FIG. 8A or FIG. 7A) (without moving to an operative position (such as the position of cam ring 15 shown in FIG. 8B)) when the control pressure is higher than or equal to the changeover pressure (Pv2) but lower than the predetermined operation pressure (Pc2).

Eighth feature; the pressure control section is arranged to alternate between the inoperative state and the operative state to hold the discharge pressure at the predetermined operation pressure (such as Pc2) by moving the movable member between the inoperative position and the operative position, to hold the discharge pressure at a predetermined pressure level. Ninth feature; the pressure control section is arranged to assume a second state or operative state (such as the state shown in FIG. 7B) to supply the control pressure to the first control oil chamber when the control pressure (P) becomes equal to or higher than a predetermined changeover pressure (such as Pv1) and a first state or inoperative state (such as the state shown in FIG. 7A) to supply the control pressure neither to the first control oil chamber nor to the second control oil chamber when the control pressure (P) is lower than the predetermined changeover pressure (such as Pv1 lower than Pv2). Tenth feature; the movable member (such as cam ring 15) is arranged to move from the inoperative position (such as the position shown in FIG. 7A) to the operative position (such as the position shown in FIG. 7B) when the control pressure (P) supplied into the first control oil chamber becomes higher than a predetermined operation pressure (Pc1 lower than Pc2) (which is set lower than the predetermined changeover pressure (such as Pv1 in the example shown in FIG. 6). Eleventh feature; the pressure control section is arranged to alternate between the first state and the second state to hold the discharge pressure at the predetermined changeover pressure (such as Pv1) by moving the movable member between the inoperative position and the operative position. Twelfth feature; the pressure control section includes a first section (which may include a control or pilot valve (40)) to control the supply and drainage of the oil to and from the first and second control chambers, respectively, and a second section (such as a solenoid valve and/or an electronic control unit) configured to control the oil pressures in the first and second control oil chambers in a higher pressure mode (FIGS. 8A and 8B, intervals "c" and "d" in FIG. 6) or a lower pressure mode (FIGS. 7A and 7B, intervals "a" and "b"). Thirteenth feature; the pressure control section may include a pilot valve and a solenoid valve. The pressure control section may further include a control unit to set the pressure control section in a first mode (solenoid on) and a second mode (solenoid off) in accordance with an operating condition of the engine.

This application is based on a prior Japanese Patent Application No. 2014-255685 filed on Dec. 18, 2014. The entire contents of this Japanese Patent Application are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

The invention claimed is:

1. A variable displacement oil pump for supplying oil to an internal combustion engine, the variable displacement oil pump comprising:

a pump element to be rotated by the internal combustion engine, and to vary inside volumes of pumping chambers to suck the oil through a suction portion and to discharge the oil through a discharge portion;

a cam ring to increase and decrease a pumping volume variation quantity of the pumping chambers;

a coil spring provided in a preloaded state and arranged to urge a movable member in a direction to increase the pumping volume variation quantity;

a first control oil chamber to produce an urging force to urge the movable member in a direction to decrease the pumping volume variation quantity, by receiving a supply of the oil discharged from the discharge portion;

a second control oil chamber to produce an urging force to urge the movable member in a direction to increase the pumping volume variation quantity, by receiving the supply of the oil discharged from the discharge portion; and a pilot valve structured to be operated before the pumping volume variation quantity becomes smallest by a discharge pressure of the oil discharged from the discharge portion, and arranged to connect the second control oil chamber with the discharge portion when the discharge pressure is lower than a predetermined changeover pressure and to connect the second control oil chamber with a drain port when the discharge pressure is higher than the predetermined changeover pressure;

wherein a preload of the coil spring is set so that, in a high engine speed region in which a maximum engine requirement oil pressure is required by the internal combustion engine, an operation oil pressure causing the cam ring to start moving in a state in which the oil discharged from the discharge portion is introduced into the first control oil chamber and the second control oil chamber is higher than the changeover pressure of the pilot valve without regard to generation of aeration in the pumping chambers.

2. The variable displacement oil pump as claimed in claim 1, wherein the cam ring has a two-step characteristic of holding a first discharge pressure in a low engine speed region, and holding a second discharge pressure higher than the first discharge pressure in the high engine speed region, and the variable displacement oil pump is arranged to satisfy the maximum engine requirement oil pressure in the high engine speed region.

3. The variable displacement oil pump as claimed in claim 2, wherein the maximum engine requirement oil pressure required by the internal combustion engine is an oil pressure used for lubrication of the internal combustion engine.

4. The variable displacement oil pump as claimed in claim 1, wherein a relationship of the operation oil pressure of the cam ring and the changeover oil pressure of the pilot valve in the high engine speed region requiring the maximum engine requirement oil pressure is set by a pressure receiving area difference between a pressure receiving area of the first control oil chamber and a pressure receiving area of the second control chamber.

5. The variable displacement oil pump as claimed in claim 1, wherein the pilot valve includes:

a valve body formed with an introduction port, a first control port leading to the first control oil chamber, a second control port leading to the second control oil chamber and the drain port configured to communicate with an atmosphere, a spool valve element received slidably in the valve body, and arranged to control a connection state of the ports, and a control spring member to urge the spool valve element with an urging force smaller than an urging force of the coil spring; and the coil spring and the control spring member are adjusted to set a relationship between the operation oil pressure of the cam ring and the changeover oil pressure of the pilot valve in the high engine speed region requiring the maximum engine requirement oil pressure.

6. A variable displacement oil pump for supplying oil to an internal combustion engine, the variable displacement oil pump comprising:

a rotor adapted to be rotated by the internal combustion engine, and provided with vanes received movably in the rotor to project from an outside circumference of the rotor;

a cam ring enclosing the rotor and the vanes, thereby defining a plurality of pumping chambers with the rotor and the vanes, and varying a pumping volume variation quantity which is a variation quantity of an inside volume of each of the plurality of pumping chambers, by moving eccentrically with respect to the rotor;

a suction portion opened in a suction region in which the inside volumes of the pumping chambers increase with rotation of the rotor;

a discharge portion opened in a discharge region in which the inside volumes of the pumping chambers decrease with rotation of the rotor;

a coil spring provided in a state of a preload and arranged to urge the cam ring in a direction to increase an eccentricity of the cam ring;

a first control oil chamber to receive the oil discharged from the discharge portion and thereby to produce an urging force to urge the cam ring in a direction to decrease the pumping volume variation quantity of the pumping chambers;

a second control oil chamber to receive the oil discharged from the discharge portion and thereby to produce an urging force to urge the cam ring in a direction to increase the pumping volume variation quantity; and a pilot valve structured to be operated before the pumping volume variation quantity becomes smallest by a discharge pressure of the oil discharged from the discharge portion, and arranged to connect the second control oil chamber with the discharge portion when the discharge pressure is lower than a predetermined changeover pressure and to connect the second control oil chamber with a drain port when the discharge pressure is higher than the predetermined changeover pressure;

wherein the preload of the coil spring is set so that, in a high pressure region higher than a maximum engine requirement oil pressure required by the internal combustion engine, an operation oil pressure causing the cam ring to start moving in a state in which the oil discharged from the discharge portion is introduced into the first control oil chamber is set higher than the changeover pressure of the pilot valve without regard to generation of aeration in the pumping chambers.

7. The variable displacement oil pump as claimed in claim 6, wherein the variable displacement oil pump is arranged to satisfy the maximum engine requirement oil pressure required in a predetermined high rotational speed region, and a relationship of the operation oil pressure of the cam ring and the changeover pressure of the pilot valve in the high pressure region which is higher than the maximum engine requirement oil pressure is set by the coil spring, and a control spring member included in the pilot valve.

8. The variable displacement oil pump as claimed in claim 7, wherein the first and second control oil chambers are formed around the cam ring and separated from each other by a swing fulcrum provided on an outside circumference of the cam ring.

* * * * *